United States Patent [19]

Freedman

[11] 4,106,123

[45] Aug. 15, 1978

[54] ARTICLE OF JEWELRY

[76] Inventor: Melvin H. Freedman, 200 E. 27th St., New York, N.Y. 10016

[21] Appl. No.: 851,626

[22] Filed: Nov. 15, 1977

[51] Int. Cl.[2] ..... A41D 25/14

[52] U.S. Cl. ..... 2/152 R; 24/115 H; 24/116 R; 403/209; 24/129R

[58] Field of Search ..... 24/74 A, 129 B, 129 R, 24/115 H, 49 S; 403/209 2/150; 152 R

[56] References Cited

U.S. PATENT DOCUMENTS 4,035,873 7/1977 Epperson ..... 2/150

4,038,724 8/1977 Parizek ..... 24/49 S

*Primary Examiner*—Bernard A. Gelak

*Attorney, Agent, or Firm*—Jacobs & Jacobs

[57] ABSTRACT

An article of jewelry to be worn encircling a portion of the body such as a neck piece or belt is formed from a length of flexible material, two portions of which are engaged by a plurality of hoops disposed on a slide, the hoops being positioned so as to receive the portions of flexible material in frictional engagement of each other, permitting adjustment of the length of flexible material between the two portions so engaged.

3 Claims, 5 Drawing Figures

ARTICLE OF JEWELRY

The present invention pertains to an article of jewelry such as a neckpiece; e.g. necklace or bola tie, decorative belt, or bracelet, intended to encircle a portion of the body.

The nature of the invention is apparent from the following description and from the accompanying drawings in which.

Figure 1:
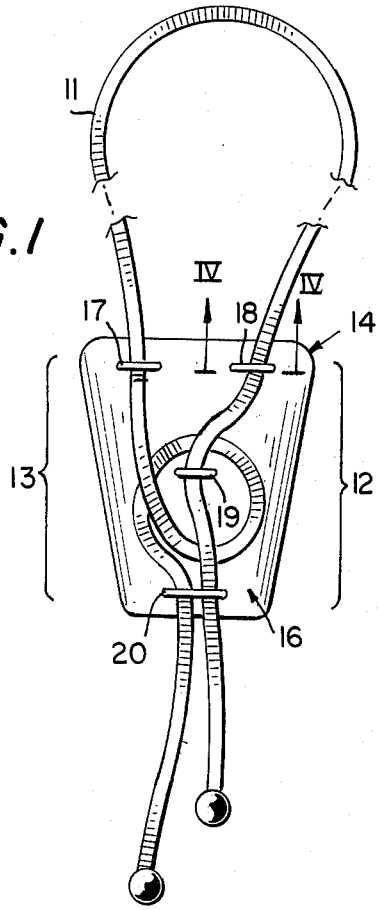
FIG. 1 is an elevation of the rear surface of the slide and portions of the flexible material engaged thereby.
Figure 2:
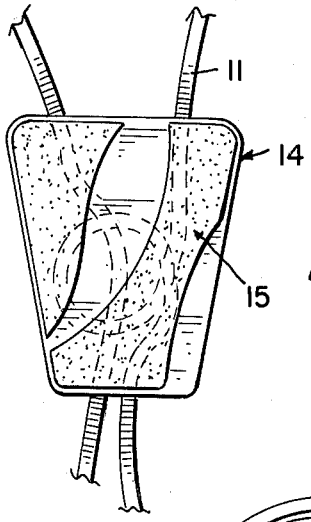
FIG. 2 is an elevation of the reverse (front) of the slide and flexible material portions shown in FIG. 1.
Figure 3:
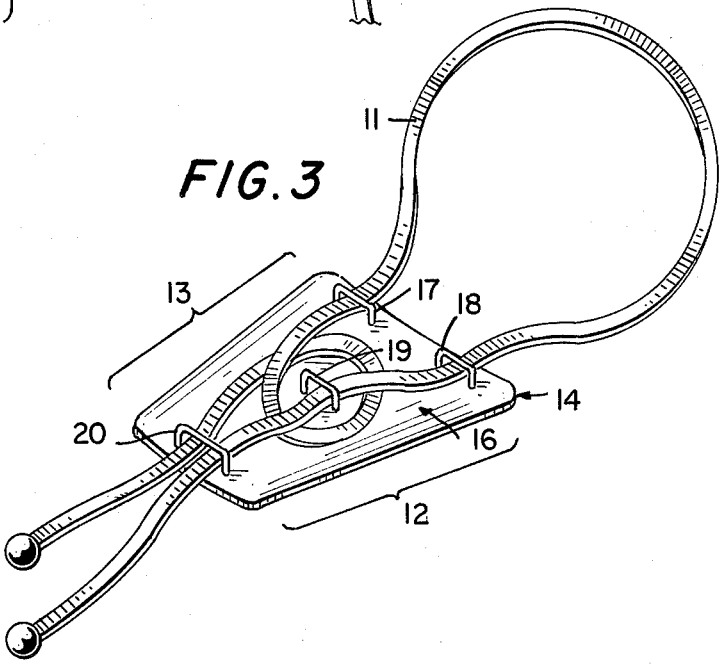
FIG. 3 is a perspective view of the embodiment shown in FIGS. 1 and 2.

Referring now in greater details to the drawings, there is shown in FIGS. 1, 2 and 3 a length of flexible material 11 which is of uniform cross-section throughout its length. Flexible material 11 is adjustably engaged at two portions 12 and 13 by a slide shown generally at 14. The front face 15 of slide 14, shown in FIG. 2 only, may be of substantially any design or configuration, it being exclusively decorative. Disposed on the rear surface 16 of slide 14 are a plurality of engagement hoops including a pair of upper engagement hoops 17 and 18, an intermediate engagement hoop 19 and at least one lower engagement hoop 20.

Figure 4:
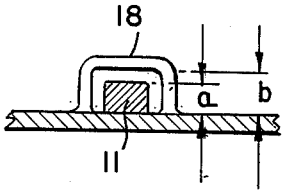
FIG. 4 is a cross-section of the hoop and flexible material taken along lines IV — IV in FIG. 1.

As can be seen from FIG. 4, which is presented with reference to hoop 18 but which is equally applicable to the other hoops, hoop 18 defines an opening the height of which $b$ is greater than the height $a$ of the cross-section of the flexible material 11 but less than twice the height of the cross-section of flexible material 11; i.e. $a<b<2a$. The width of the hoop is not critical, being generally slightly greater than the width of the cross-section of flexible material 11 except in those cases in which there is a single lower engagement hoop in which case the width will be slightly greater than twice the width of flexible material 11 in order to accommodate two portions of the material passing through a single hoop. Thus in general, the dimensions of the opening within the hoops is such that the flexible material can pass freely through them in the absence of the engagement arrangement hereinafter described.

Two portions of the flexible material are engaged by the slide with the length between the two portions intended to encircle a portion of the body such as the neck or waist. A first of these engaged portions 12 passes through one of the upper hoops 17. It then passes round the intermediate hoop 19 so as to form a loop by crossing over or under itself. Portion 12 then continues, passing through the lower hoop 20. The second of the portions 13 passes through the other of the other hoops 18. It then passes over an area formed by the loop of first portion 12, through intermediate hoop 19, over another area of the loop formed by first portion 12 and then out through lower hoop 20.

By reason of the flexible nature of 11 and the dimensions of the hoops 17, 18, 19 and 20, the two portions of flexible material are frictionally engaged with one another but can be worked through the hoops so as to permit adjustment of size of the encircling portion.

Figure 5:
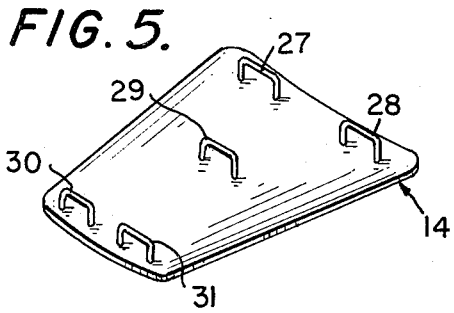
FIG. 5 is a perspective view of alternative embodiment of the slide.

An alternative embodiment is shown in FIG. 5 in which in place of a single lower loop accommodating both portions of flexible material 11, there are two lower loops, 30 and 31. The arrangement of the two portions of the flexible material with regard to upper engagement hoops 27 and 28 and intermediate engagement hoop 29 is identical with that described in connection with FIGS. 1, 2 and 3.

The nature of the flexible material can vary widely. It can for example be a decorative fabric cord of circular cross-section, a strip of leather or a metal chain of the type generally identified in the art as a "snake chain". The present invention is particularly well suited for articles of jewelry fabricated from the latter material in which a plurality of like links are joined in repeating orientation so as to produce a flexible length of metal of substantially constant cross-section since heretofore there has not been any convenient way of engaging such material in an adjustable manner without running the risk of scratching its surface or destroying its flexible nature.

What is claimed is:

1. An article of jewelry operable to encircle a portion of the body comprising (a) a length of flexible material of uniform cross-section and (b) a slide operable to adjustably engage two portions of said length, said slide having disposed on its rear surface (i) a pair of upper engagement hoops, (ii) an intermediate engagement hoop and (iii) at least one lower engagement hoop, each of said hoops defining an opening having a height greater than the cross-section of said flexible material but less than twice said cross-section, a first of said portions of flexible material passing through one of said upper hoops, around said intermediate hoop, crossing over or under itself so as to form a loop and out through said lower hoop and the other portion of said flexible material passing through the second of said upper hoops, over an area of the loop formed by said first portion, through said intermediate hoop, over a second area of said loop and out through a lower engagement hoop.

2. An article according to claim 1 wherein said flexible material is a metal chain.

3. An article according to claim 1 wherein there is a single lower engagement hoop of a width greater than twice the cross-section of said flexible material.

* * * * *